US005222509A

United States Patent [19]

Imai et al.

[11] Patent Number: 5,222,509

[45] Date of Patent: Jun. 29, 1993

[54] METHOD OF MAKING CIGARETTES AND APPARATUS THEREFORE

[75] Inventors: Kunio Imai; Katsutoshi Keira, Iwate, both of Japan

[73] Assignee: Japan Tobacco Inc., Tokyo, Japan

[21] Appl. No.: 793,144

[22] Filed: Nov. 18, 1991

[30] Foreign Application Priority Data

Nov. 22, 1990 [JP] Japan ..... 2-316043

[51] Int. Cl.[5] ..... A24C 5/24

[52] U.S. Cl. ..... 131/69; 131/284; 118/259

[58] Field of Search ..... 131/69, 284; 118/258, 118/259, 262

[56] References Cited

U.S. PATENT DOCUMENTS

| | | | |
|---|---|---|---|
| 1,899,628 | 2/1933 | Molins | 131/69 X |
| 2,149,896 | 3/1939 | McArdle et al. . | |
| 2,543,277 | 2/1951 | Copeman . | |
| 4,252,527 | 2/1981 | Hall . | |
| 4,371,571 | 2/1983 | McIntyre et al. . | |
| 4,998,474 | 3/1991 | Hauer | 118/259 X |
| 5,037,671 | 8/1991 | Karna et al. | 118/259 X |

FOREIGN PATENT DOCUMENTS

| | | | |
|---|---|---|---|
| 48-40500 | 9/1973 | Japan . | |
| 60-182796 | 12/1985 | Japan . | |
| 0764738 | 9/1980 | U.S.S.R. | 118/259 |

*Primary Examiner*—V. Millin
*Assistant Examiner*—J. Doyle

[57] ABSTRACT

A method of and apparatus for stabilizing shredded tobacco leaves at an end of a cigarette will prevent the shredded tobacco leaves from dropping the cigarette. The method comprises the steps of: applying adhesive to a paper wrapper in the crosswise direction with a pitch identical with the length of the cigarette for form strips of an adhering portion; feeding shredded tobacco leaves on to the paper wrapper to stick the shredded tobacco leaves with the adhesive on the strips of adhering portion; forming a cigarette rod by winding the paper wrapper to bond both ends of the paper wrapper after applying adhesive to both ends of the paper wrapper; and cutting the cigarette rod at the strips of adhering portion to form a single cigarette with a given length. Further, the cigarette making apparatus for the above method is provided with an adjusting apparatus comprising: an adhesive roller having concave portions on an outer periphery thereof; an accommodating chamber for accommodating pressurized adhesive therein; and an adhesive nozzle having an opening, an end of the adhesive nozzle being in contact with the outer periphery of the adhesive roller. A position for the adhesive roller is adjusted such that positions for the concave portion to put adhesive on the paper wrapper coincides with positions cut by a cutting portion.

17 Claims, 5 Drawing Sheets

METHOD OF MAKING CIGARETTES AND APPARATUS THEREFORE

BACKGROUND OF THE INVENTION

1. Field of the Invention

This invention relates to a method of and apparatus for making cigarettes in which shredded tobacco leaves at an end of cigarettes are stabilized to prevent them from dropping from the cigarette.

2. Description of the Prior Art

Transportation of cigarette in speed-up of in cigarette making machines considerably affects a problem in the quality of cigarettes which have an incomplete end in that the shredded tobacco leaves tend to slide from the end of the cigarettes.

Judging from the condition that cigarettes with incomplete end are produced, vibration and impact during the transportation cause shredded tobacco leaves to slide from an inner surface of the paper wrapper, then, the shredded tobacco leaves drop one after another due to a lock of adhesion between the shredded tobacco leaves resulting in production of cigarettes with an incomplete end. The sliding of the shredded tobacco leaves from the inner surface of the paper wrapper is more susceptible than the dropping of the leaves from a center of the end.

Therefore, it is necessary to reduce cigarettes with an incomplete end in the cigarette making process to thereby improve quality of the cigarettes.

As a method for preventing production of the cigarettes with incomplete end, more shredded tobacco leaves are put at a portion adjacent to a cut face of the cigarette than the other portion to increase frictional force between shredded tobacco leaves. As a result, the shredded tobacco leaves are prevented from sliding from the end.

That is, as shown in FIG. 9, shredded tobacco leaves pneumatically transported in a feed passage 1 are absorbed on a lower surface of a suction conveyor 2 and the shredded tobacco leaves T are fed to a trimming disk 3.

As described in FIG. 10, the trimming disk 3 is provided with two disks 3*a* and 3*b* parallel to each other with five concave portions 4 on the outer surface thereof and a feed passage is formed for the shredded tobacco leaves T between the rotating disks 3*a* and 3*b*.

Since the shredded tobacco leaves T are accommodated and transported in a heap to a paper wrapper 5 after passing through the trimming disk 3, portions 6 containing more shredded tobacco leaves than the other portion are produced. The distance 1 between the portions 6 is identical with the circumferential pitch of the concave portions 4.

As a result, when the paper wrapper 5 is wound at the succeeding process to form a cigarette, the portions 6 are packed with more shredded tobacco leaves, and frictional force is increased between the shredded tobacco leaves. Therefore, when a cigarette rod is cut at the portions 6 to produce a single cigarette having a length 1, it is difficult for the shredded tobacco leaves to slide from the end, preventing the cigarettes with incomplete end from being produced.

Although this method is effective to prevent a cigarette with an incomplete end from being produced, actually, more shredded tobacco leaves should be packed at a portion adjacent the end, resulting in loss of tobacco leaves.

Meanwhile, as other prior arts for preventing cigarettes with incomplete end from being produced, Japanese Utility Model Application Pub. Nos. 48-40500 and 60-182796 are disclosed.

Prior art disclosed in the former Japanese Utility Model Application Pub. No. 48-40500 is for preventing shredded tobacco leaves from dropping by pasting a piece of paper or the like on an end of a cigarette. On the other hand, in prior art disclosed in the latter Utility Model Application Pub. No. 60-182796, an end of a cigarette is covered by a piece of paper or a tobacco leaf, or an adhesive is sprayed, applied, or impregnated on an end of a cigarette.

However, it is not easy to cover an end of a cigarette by a lid while maintaining appearance of the cigarette. Moreover, there is a problem that a new apparatus for applying the lid must be added in the cigarette making process.

SUMMARY OF THE INVENTION

It is therefore the object of the present invention to eliminate the above drawbacks and to provide cigarettes in which only shredded tobacco leaves being in contact with inner surface of the cigarettes are sustained in consideration that shredded tobacco leaves slide from an inner surface of the paper wrapper, then, the shredded tobacco leaves drop one after another due to a lock of adhesion between the shredded tobacco leaves, resulting in production of cigarettes with an incomplete end because the sliding of the shredded tobacco leaves from the inner surface of the paper wrapper is more susceptible that the dropping of the leaves from a center of the end.

In order to achieve the objective described above, the method of stabilizing shredded tobacco leaves at an end of a cigarette at an end thereof according to the present invention comprises the steps of: applying adhesive to a paper wrapper in the crosswise direction with a pitch identical with the length of the cigarette to form strips of adhering portion; feeding shredded tobacco leaves on the paper wrapper to stick the shredded tobacco leaves with the adhesive on the strips of the adhering portion; forming a cigarette rod by winding the paper wrapper to bond both ends of the paper wrapper after applying adhesive to the both ends of the paper wrapper; and cutting said cigarette rod at the strips of adhering portion to form the single cigarette with the length.

Further, the apparatus used for the method of stabilizing shredded tobacco leaves at an end of a cigarette comprises: a feed passage for transporting a paper wrapper applied from a paper wrapper bobbin to a shredded tobacco leaves feed portion; a winding portion for winding the paper wrapper with shredded tobacco leaves thereon, which is positioned downstream from the feed portion to produce a cigarette rod; a cutting portion for cutting said cigarette rod into a prescribed length; an adjusting apparatus which has an adhesive roller having a cylindrical shape, a rotation shaft inserted in an axis thereof, an concave portions parallel to the rotation shaft on an outer periphery thereof, the adhesive roller being installed in the feed passage; and accommodating chamber for accommodating pressurized adhesive therein; and an adhesive nozzle having an opening communicating with the accommodating chamber at an end thereof, an end of the adhesive nozzle being in contact with the outer periphery of the adhesive roller, position of the adhesive roller is adjusted such that positions that the adhesive transported on the concave portion is put on the paper wrapper on the feed passage coincides with positions cut by the cutting portion.

The method for stabilization using the apparatus for stabilizing shredded tobacco leaves at an end of a cigarette is explained below.

The adhesive pressurized and accommodated in the accommodating chamber is filled in the concave portion on the outer periphery of the adhesive roller rotating while being in contact with the opening of the adhesive nozzle.

Meanwhile, the paper wrapper is applied from the paper wrapper bobbin and is in contact with the adhesive roller in the middle of the feed passage where the paper moves.

The relation between the circumferential velocity of the adhesive roller and the traveling velocity of the paper wrapper is determined so that the pitch of the adhesive transferred to the paper wrapper becomes equal to the length of the cigarette. Then, the adhesive in the concave portion is transferred to the paper wrapper.

The concave portion is parallel to the rotation shaft of the adhesive roller, that is, parallel to the crosswise direction of the paper wrapper. Then, adhering portions each with a strip shape are formed in the crosswise direction of the paper wrapper.

The pitch of the adhering portions are identical with the length of the cigarette.

The paper wrapper with adhering portions is transported to the shredded tobacco leaves feed portion to put shredded tobacco leaves on the paper wrapper and only shredded tobacco leaves of the adhering portion are pasted.

Then, the paper wrapper is wound like a bar in the winding portion to form a cigarette rod. Then, the roller paper is transported to the cutting portion.

The adjusting apparatus adjusts the position of the adhering portion so that the pasting position is aligned with the cutting position of the cutting portion. As a result, the adhering portion is formed at an end of a single cigarette to prevent shredded tobacco leaves in contact with the inner surface of the cigarette from dropping, and preventing cigarettes with an incomplete end from being produced.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will be more apparent from the ensuring description with reference to the accompanying drawings which are given by way of illustration only, and thus are not limitative of the present invention, and wherein:

FIG. 8 is a longitudinal cross-sectional view of the adhesive roller, the rotation shaft, and the like;

DETAILED DESCRIPTION OF PREFERRED EMBODIMENTS

Now, the embodiments o the present invention will be explained with reference to the drawings.

Figure 1:
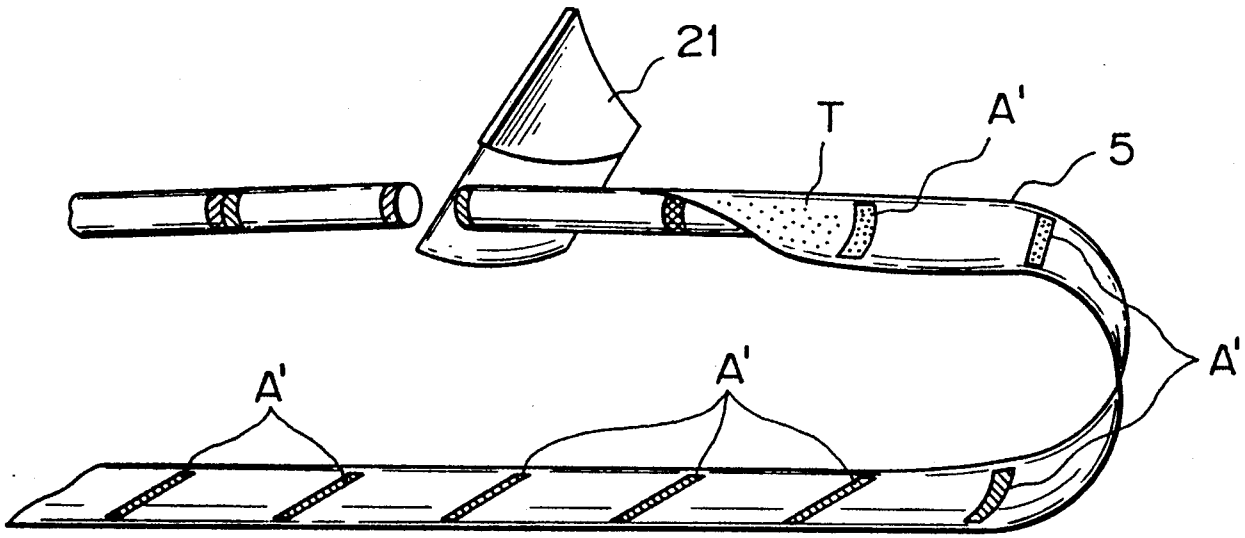
FIG. 1 is a perspective view showing a method of stabilizing shredded tobacco leaves of a cigarette at an end thereof.
Figure 2:
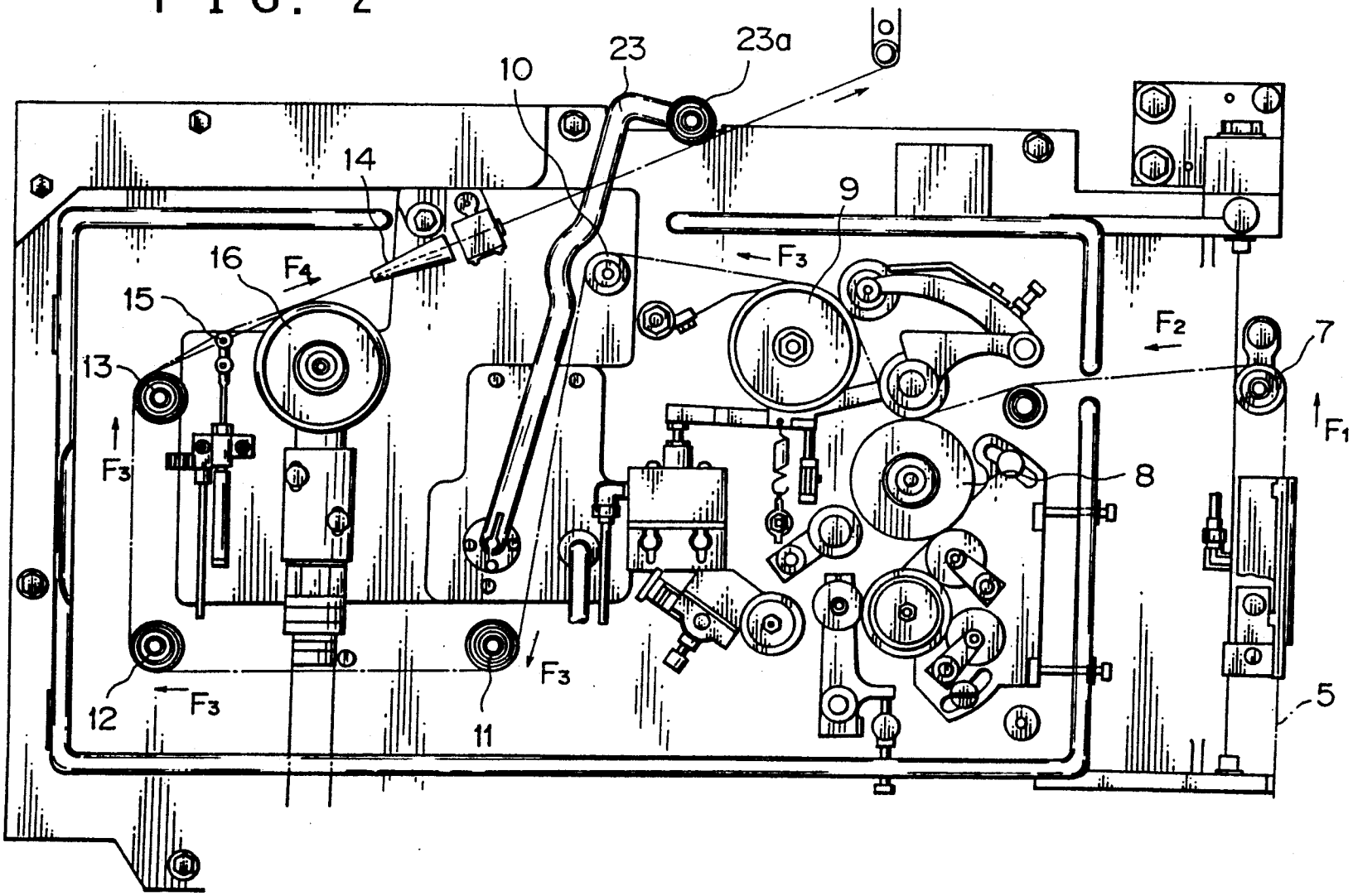
FIG. 2 is a front view of an apparatus for stabilizing shredded tobacco leaves of a cigarette at an end thereof.

FIG. 1 is a perspective view showing a method of stabilizing shredded tobacco leaves at an end of a cigarette and FIG. 2 shows a front view of an apparatus for stabilizing shredded tobacco leaves at an end of a cigarette. As shown in FIG. 2, a paper wrapper 5 applied from a paper wrapper bobbin is transported in the direction shown by the arrow F1 along a feed passage and then is bent along a roller 7 to be transported to a feed passage shown by the arrow F2. When the paper wrapper passes a printing roller 8, the name o the cigarette and the like are printed and then the paper wrapper is transported to a feed passage F4 between a roller 13 and a cylindrical paper guide 14 after passing through winding feed passage F3 formed by a paper feed roller 9, a roller 10, a roller 11, and a roller 12. The roller 13 has a central axis which is at a fixed distance from the axis of rotation of the adhesive roller 16. The axis of roller 13 is also fixed.

The feed passage F4 is provided with a lift roller 15 and an adhesive roller 16. When the lift roller recedes from the feed passage F4 for the paper wrapper 5, the paper wrapper is in contact with the outer periphery of the adhesive roller. On the other hand, when the lift roller projects from the feed passage F4, the paper wrapper 5 separates from the outer periphery of the adhesive roller 16.

Figure 6:
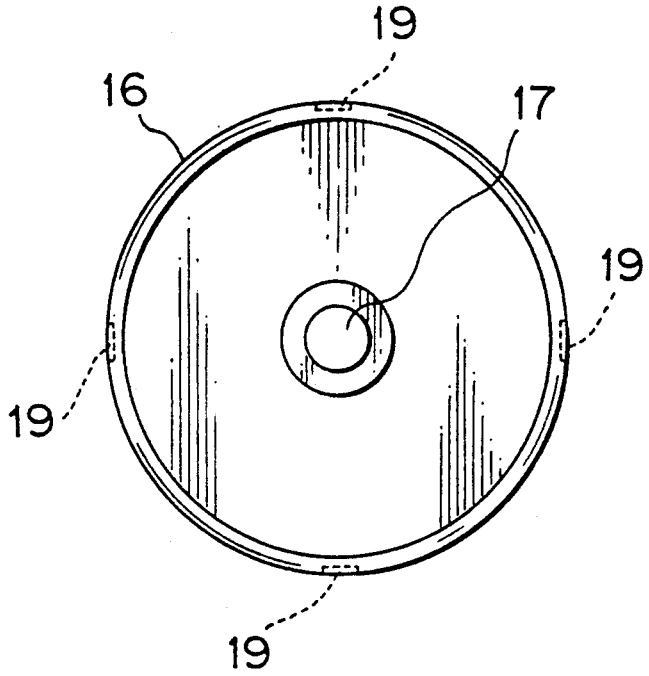
FIG. 6 is a front view of the adhesive roller.
Figure 7:
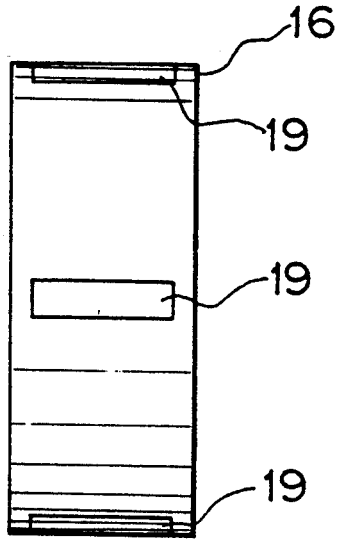
FIG. 7 is a side view of the adhesive roller of FIG. 6.
Figure 8:
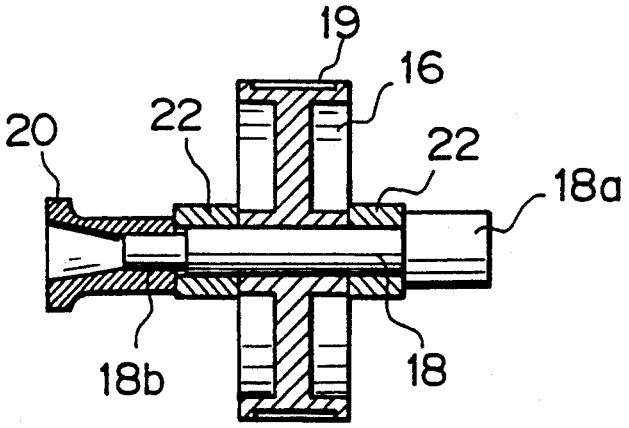
Figure 9:
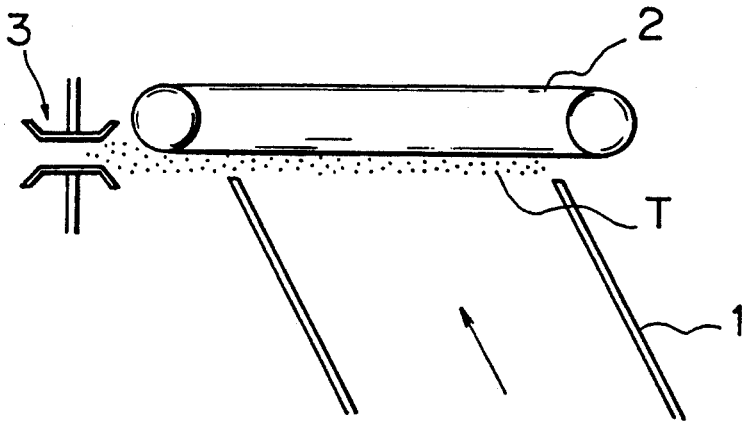
FIG. 9 PRIOR ART
FIG. 9 is a schematic drawing for explaining conventional shredded tobacco leaves feed process.
Figure 10:
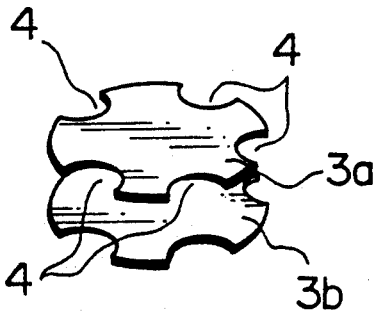
FIG. 10 PRIOR ART
FIG. 10 is a perspective view of the trimming disk used for the conventional shredded tobacco leaves feed process.
Figure 11:
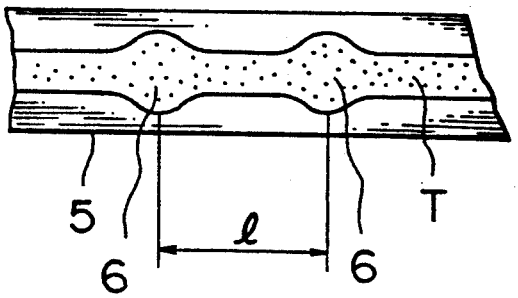
FIG. 11 PRIOR ART
FIG. 11 is a primarily plan view for explaining the condition that shredded tobacco leaves are put on a paper wrapper.

As described in FIGS. 6, 7, and 8, the adhesive roller 16 is inserted on a rotation shaft 18 in a hole at the axis thereof and is provided with four shallow concave portions 19 parallel to the hole 17 on the outer periphery thereof.

The rotation shaft 18 is provided with a flange **18*a* at an end thereof and male screw 18*b* at the other end thereof. An adjusting device is threadedly fitted to the male screw 18*b***.

The adjusting device 20 synchronizes the rotation of the adhesive roller 16 and cutting operation of the cutter 21 (refer to FIG. 1) installed downstream from the adhesive roller. The adjusting device is locked after the rotation angle of the past roller is fixed so that portions of the paper wrapper 5 overlapping the concave portions 19 coincide with positions cut by the cutter 21 and the adhesive roller 16 is put between spacers 22 to fix the adhesive roller 16 to the rotation shaft 18.

Further, fine adjustment of the synchronization with the cutting operation can be performed by adjusting the inclination of a positioning lever 23 having at an end thereof a roller 23a which is in contact with the paper wrapper 5.

Figure 3:
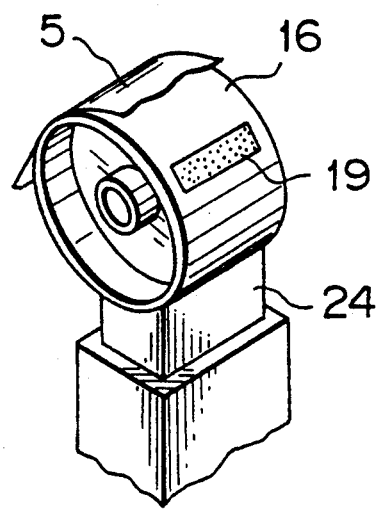
FIG. 3 is a perspective view showing primary portions of the adhesive roller and adhesive nozzle.

The outer periphery of the adhesive roller 16 is in contact with a tip 24a of the adhesive nozzle 24 (refer to FIG. 3).

Figure 4:
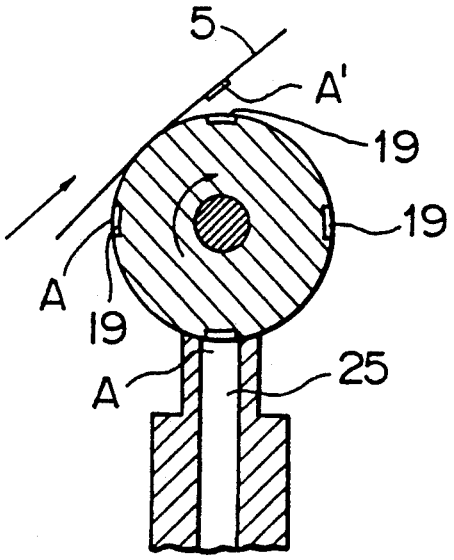
FIG. 4 shows a longitudinal cross-sectional view illustrating the condition that the adhesive is transferred.
Figure 5:
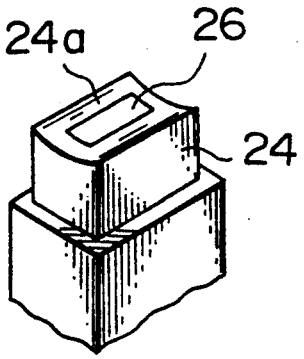
FIG. 5 is a perspective view showing the primary portion of the adhesive nozzle.

As shown in FIGS. 4 and 5, a longitudinal cross-sectional view and perspective view respectively, the adhesive nozzle 24 is provided with an accommodating chamber for accommodating adhesive A therein and is provided at the end surface thereof with an opening 26 communicating with the accommodating chamber 25 so that the pressurized adhesive A comes in contact with the outer periphery of the adhesive roller 16.

As described in FIG. 1, shredded tobacco leaves T are fed to the paper wrapper 5 passing through the feed passage F4 and the adhesive is applied to the side end of the paper wrapper 5. Then, the paper wrapper 5 is transported to the winding portion, where the paper wrapper 5 is wound, and is further transported to the cutting portion to be cut.

Next, a method for stabilization using the apparatus for stabilization with the structure described above will be explained.

The adhesive accommodated in the accommodating chamber 25 of the adhesive nozzle 24 is pressurized and is in contact with the adhesive roller 16 under the pressurized state at the opening 26 of the end surface 24a. The adhesive roller 16 rotates while being in contact with the end surface 24a of the adhesive nozzle 24 and the adhesive A is accommodated in the concave portion 19.

Meanwhile, the paper wrapper 5 is applied from the paper wrapper bobbin and passes through the feed passages F1, F2, and F3 to be in contact with the adhesive roller 16 during the travel at the feed passage F4 since the lift roller recedes from the passage F4.

The circumferential velocity of the adhesive roller 16 is equal to the feed velocity of the paper wrapper 5. Therefore, the adhesive accommodated in the concave portion 19 is transferred to the paper wrapper 5 at predetermined intervals identical with the length of the single cigarette (refer to FIG. 4).

Since the concave portion 19 is parallel to the rotation shaft 18 of the adhesive roller 16, that is, parallel to the crosswise direction of the paper wrapper 5, strips of adhering portion A' are formed in the crosswise direction of the paper wrapper 5. The paper wrapper 5 is further transported to the shredded tobacco leaves feed portion where the shredded tobacco leaves T are put on the paper wrapper and only shredded tobacco leaves T on the adhering portions are stuck to the inner surface of the paper wrapper 5.

Then, the paper wrapper 5 with the adhesive A' on the inside of the end is further wound to form a cigarette rod. Then, the paper wrapper 5 is transported to the cutting portion to be cut by the cutter 21.

The position to be cut by the cutter 21 is adjusted so as to coincide with the adhering portion A' where the adhesive is transferred. Therefore, the adhering portion A' is positioned at the end of the single cigarette and the shredded tobacco leaves are in contact with the inner surface of the paper wrapper 5 at the end portion thereof. As a result, the stuck shredded tobacco leaves T adjacent the end of the paper are prevented from dropping, such that cigarettes with an incomplete end are not produced.

Since the cigarette making apparatus according to the present invention has the structure described above, the following effect will be obtained.

Adhesive applied to an inner surface of a paper wrapper of the cigarette sustains shredded tobacco leaves which are in contact with the inner periphery of the paper wrapper, to prevent other shredded tobacco leaves from dropping by the shredded tobacco leaves being sustained by the adhesive. Accordingly, it is possible to prevent shredded tobacco leaves from dropping with a minimum quantity of adhesive.

Therefore, the cigarettes produced by the present invention are smoked while maintaining taste, smell and appearance of cigarettes conventionally smoked, and health of smokers, and with minimum quantity of adhesive similar to a conventional method.

The apparatus for stabilizing shredded tobacco leaves at an end of a cigarette has advantages such as a few parts, simple structure, compactness, easy built-in performance to conventional cigarette making process, and economical cost for installation.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

What is claimed is:

1. A method of making cigarettes comprising the steps of:

providing a paper wrapper having a predetermined width;

sequentially applying discrete strips of adhesive to the paper wrapper in the cross-wise width direction with a pitch corresponding to a length of a cigarette to form discrete strips of adhering portion on the paper wrapper;

feeding shredded tobacco leaves on said paper wrapper after the step of applying adhesive to stick said shredded tobacco leaves with said adhesive on said strips of adhering portion;

forming a cigarette rod by winding said paper wrapper to bond said both ends of said paper wrapper; and cutting said cigarette rod at said strips of adhering portion to form said cigarette.

2. The method of making cigarettes as recited in claim 1, wherein the step of cutting cuts the cigarette rod within a region having the adhering portion such that the cigarettes formed have adhesive at both ends thereof.

3. The method of making cigarettes as recited in claim 1, wherein the step of applying adhesive uses an adhesive applying apparatus to apply the adhesive and wherein the method further comprises the steps of:

providing a reciprocable lift roller upstream of the adhesive applying apparatus; and moving the lift roller in engagement with the paper wrapper to move the paper wrapper into and out of engagement with the adhesive applying apparatus, adhesive being applied to the paper wrapper when the lift roller is moved to bring the paper wrapper into engagement with the adhesive applying apparatus.

4. The method of making cigarettes as recited in claim 3, wherein the adhesive applying apparatus includes an adhesive roller rotatable about a rotation axis and wherein the method further comprises the steps of:

providing a first roller upstream from the lift roller, the first roller having a central axis; and rotating the adhesive roller about the rotation axis to supply discrete strips of adhesive, the rotation axis of the adhesive roller being fixed relative to the central axis of the first roller and the lift roller having a central axis which is movable relative to the central axis o the first roller and the rotation axis of the adhesive roller as the lift roller reciprocates.

5. The method of making cigarettes as recited in claim 4, wherein the adhesive roller has a plurality of discrete portions along an outer circumference thereof, the adhesive applying apparatus further comprises an accommodating chamber, the method further comprises the step of supplying the adhesive to the plurality of discrete portions from the accommodating chamber whereafter the adhesive roller is rotated about the rotation axis to supply the adhesive to the paper wrapper, the discrete portions supplying discrete quantities of adhesive to the paper wrapper.

6. The method of making cigarettes as recited in claim 1, further comprising the steps of:

moving the paper wrapper from a paper wrapper bobbin past an adhesive applying apparatus whereat the adhesive is applied in discrete strips to the paper wrapper, the paper wrapper moving past the adhesive applying apparatus in a first direction; and moving the paper wrapper in a second direction which is generally perpendicular to the first direction in order to move the paper wrapper into and out of engagement with the adhesive applying apparatus.

7. The method of making cigarettes as recited in claim 1, further comprising the steps of:

providing a positioning lever engageable with the cigarette rod after the cigarette rod is formed by winding and before the cigarette rod is cut; and moving the positioning lever to adjust synchronization of the cutting of the cigarette rod into cigarettes of a prescribed length.

8. A cigarette making apparatus comprising:

a shredded tobacco leaves feed portion for feeding shredded tobacco leaves to a paper wrapper;

a feed passage for transporting the paper wrapper applied from a paper wrapper bobbin to said shredded tobacco leaves feed portion;

a winding portion for winding said paper wrapper with said shredded tobacco leaves thereon, which is positioned downstream from said shredded tobacco leaves feed portion, to produce a cigarette rod;

cutting portion for cutting said cigarette rod into cigarettes each having a prescribed length;

an adhesive applying apparatus upstream of the shredded tobacco leaves feed portion comprising:

a generally cylindrical adhesive roller rotatable about a rotation axis, a rotation shaft being inserted in the rotation axis, said adhesive roller being installed in the feed passage;

a plurality of discrete concave portions generally parallel to said rotation shaft on an outer periphery of said adhesive roller;

an accommodating chamber for accommodating pressurized adhesive therein;

an adhesive nozzle having an opening communicating with said accommodating chamber at an end thereof, said end of said adhesive nozzle being in contact with said outer periphery of said adhesive roller, and adhesive being supplied from the accommodating chamber through the adhesive nozzle sequentially to the concave portions, rotation of the adhesive roller bringing the adhesive in the concave portions into engagement with the paper wrapper such that discrete strips of adhesive are applied in a crosswise width direction onto the paper wrapper, the discrete strips of adhesive being placed on the paper wrapper before the shredded tobacco leaves are fed to the paper wrapper.

9. The cigarette making apparatus as recited in claim 8, wherein four discrete concave portions are provided on the outer periphery of the adhesive roller, the concave portions being generally equally spaced around the outer periphery of the adhesive roller.

10. The cigarette making apparatus as recited in claim 8, further comprising a first roller provided upstream of the adhesive applying apparatus, the first roller being rotatable about a central axis and the central axis of the first roller and the rotation axis of the adhesive roller being a fixed distance from one another.

11. The cigarette making apparatus as recited in claim 10, further comprising means for moving the paper wrapper toward and away from the adhesive roller, the rotation axis of the adhesive roller being generally fixed, the means for moving being located between the first roller and the adhesive applying roller.

12. The cigarette making apparatus as recited in claim 8, further comprising means for moving the paper wrapper toward and away from the adhesive roller, the rotation axis of the adhesive roller being generally fixed.

13. The cigarette making apparatus as recited in claim 12, wherein the means for moving comprises a reciprocable lift roller movable to move the paper wrapper toward and away from the adhesive roller.

14. The cigarette making apparatus as recited in claim 2, wherein the paper wrapper is moved from the paper wrapper bobbin past the adhesive applying apparatus whereat the adhesive is applied in discrete strips to the paper wrapper, the paper wrapper moving past the adhesive applying apparatus in a first direction, the cigarette making apparatus further comprises means for moving the paper wrapper in a second direction which is generally perpendicular to the first direction in order to move the paper wrapper into and out of engagement with the adhesive applying apparatus.

15. The cigarette making apparatus as recited in claim 14, wherein the means for moving comprises a reciprocable lift roller positioned downstream of the adhesive applying apparatus.

16. The cigarette making apparatus as recited in claim 8, further comprising a lift roller, the lift roller being reciprocable to move the paper wrapper into and out of engagement with the adhesive applying roller.

17. The cigarette making apparatus as recited in claim 8, further comprising a positioning lever engageable with the cigarette rod after the cigarette rod is formed by the winding portion and before the cigarette rod is cut by the cutting portion, the positioning lever being movable to adjust synchronization of the cutting of the cigarette rod into cigarettes of the prescribed length.

* * * * *